US011621153B2

(12) United States Patent
Javahery et al.

(10) Patent No.: US 11,621,153 B2
(45) Date of Patent: Apr. 4, 2023

(54) MASS SPECTROMETRY OF SURFACE CONTAMINATION

(71) Applicant: Quadrocore Corp., Toronto (CA)

(72) Inventors: Gholamreza Javahery, Thornhill (CA); Ali Sepehri Fard, King (CA)

( * ) Notice: Subject to any disclaimer, the term of this patent is extended or adjusted under 35 U.S.C. 154(b) by 40 days.

(21) Appl. No.: 17/341,153

(22) Filed: Jun. 7, 2021

(65) Prior Publication Data

US 2021/0391163 A1 Dec. 16, 2021

Related U.S. Application Data

(60) Provisional application No. 63/038,947, filed on Jun. 15, 2020.

(51) Int. Cl.
*H01J 49/04* (2006.01)
*H01J 49/16* (2006.01)

(52) U.S. Cl.
CPC ..... *H01J 49/049* (2013.01); *H01J 49/16* (2013.01)

(58) Field of Classification Search
CPC ..... H01J 49/049; H01J 49/16
USPC ..... 250/281, 282, 283, 288
See application file for complete search history.

(56) References Cited

U.S. PATENT DOCUMENTS

2008/0073502 A1* 3/2008 Schneider ..... H01J 49/067 250/288
2018/0301328 A1* 10/2018 Yu ..... H01J 49/165

* cited by examiner

*Primary Examiner* — Nicole M Ippolito
(74) *Attorney, Agent, or Firm* — Nasser Ashgriz; UIPatent Inc.

(57) ABSTRACT

A system for sampling and analysis of the chemical composition of any material from any surface is provided. The system comprises of a sniffing line to collect a specimen from a surface for evaluation and a thermal desorption system to thermally desorb an analyte from the sampled material, The system may further comprise of an ionization system to form an ionized analyte. A mass spectrometer is then used to analyze the chemical composition of the ionized analyte sample.

12 Claims, 11 Drawing Sheets

MASS SPECTROMETRY OF SURFACE CONTAMINATION

RELATED APPLICATION

The present invention claims the priority date of a U.S. provisional patent application No. 63/038,947 filed on Jun. 15, 2020.

FIELD OF THE INVENTION

The present invention relates in general to mass spectroscopy and in particular to analyte sampling from any surface and its analysis using a MS.

BACKGROUND OF THE INVENTION

There is a need for improving security at a number of high traffic and strategic locations, such as airports, government offices, and borders. One important security hazard is the transport of hazardous chemical and biological materials. In addition, better security is needed to detect transport of illicit drugs. This need has resulted in the development of sensitive detecting devices to detect minute amounts of vapor and particles from various chemical and biological materials. These systems operate based on obtaining a sample from a surface and introducing it into a detector for analysis. Traces of the chemical and biological material may be transferred to the body or any article of the person that has handled such material. By wiping the body or the article with a swap, some of that material may be collected for analysis. The swap is introduced into a thermal desorption system to release a vapor of the material collected, which is then introduced into an analyzer. In addition to swaps, some systems apply a suction onto the surface, using a vacuum pump, to collect the material. The material collected is then introduced into a detector for analysis. A commonly used detector is an Ion Mobility Spectrometer (IMS) or an Ion Trap Mobility Spectrometer (ITMS).

In view of the above, it is an object of the present invention to provide a more direct and sensitive detection system that detects minute traces of both vapors and particles from target materials. For this purpose, a mass spectrometry is more suitable because of its capacity for the detection of the sample material with high sensitivity, resolution and accuracy. Tandem mass spectrometer, in particular, is a technology with the ability to select a target parent molecule and identify it from a unique fragment profile patterns. Quantification (how much in the sample) and qualification (what is in the sample) are two important qualities of the tandem mass spectrometers, specifically that of triple quadrupole, that other technologies do not have. The biggest disadvantage of the mass spectrometers in the past was related to their size (not portable) and cost. Ion trap mass spectrometers are exception from these criteria because of their small sizes, therefore this technology was attractive for development of small and portable detection system. Unfortunately, because of its intrinsic limited ion storage capacity, this technology could not respond positively to detection of desired molecules from complex mixtures.

Triple quadrupole mass spectrometers with ability to function under continuous beam of ions are uniquely positioned to detect a minute amount of desired sample from a complex mixture with high sensitivity (femto-gram) and accuracy (high resolution). A portable and affordable type of technology is suitably needed to respond adequately for detection of wide range of samples.

SUMMARY OF THE INVENTION

A system for analyzing a chemical composition of a sampled material is provided. The system comprises of a sniffing line to take a sample from a surface. The sniffing line may use the pumping system of the mass spectrometer or an extra pump to generate suction. The system may also use a swap to wipe the surface for sample collection. The martial collected is then introduced into a thermal desorption system to collect the vapor and gaseous analyte desorbed from a sample. The vapor is then introduced into an ionizer and is then directed into a mass spectrometer. The mass spectrometer allows for surface analysis in real time for the detection and quantitation of materials deposited on a surface.

The present device may sample a surface that may contain a layer of a cell, or a contamination by a chemical or biological agents. It can take samples from the surfaces of any item, such as a ticket and or a boarding card in the airports, and test for residue of explosives or narcotics materials.

The present sampling and detection system is capable of releasing and extracting particles and vapors from any surface using a sniffing line. The system may also have an air jet system to generate air jets to impinge on the surface to dislodge the sample material and force them to enter into the sniffing line.

One object of the present invention is to increase the sensitivity of the detection system by using a mass spectrometer for the material analysis. This system can detect extremely low concentrations of materials.

Another object of the present invention is to provide a handheld sniffer to take samples from any surface, and provide real time detection of any chemical and biological material. This increases the speed of the detection process, and hence throughput the test of articles or people, which in turn, reduces the cost of the inspection and inconvenience.

These and other objects of the present invention will become apparent from a reading of the following specification, taken in conjunction with the enclosed drawings.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1A:
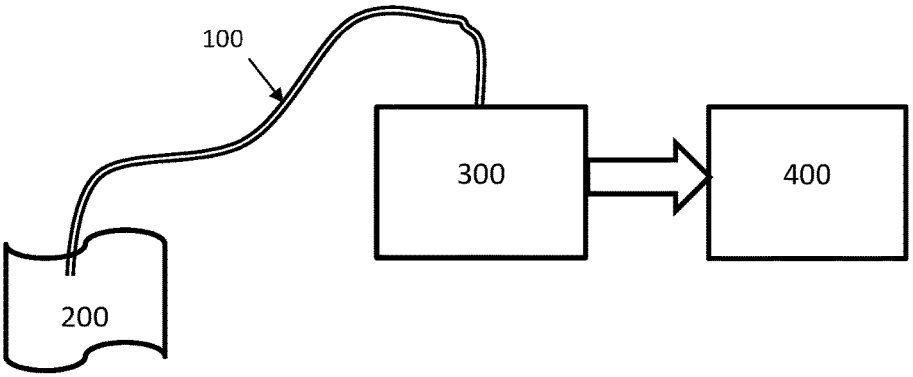
FIG. 1A shows the main elements of one embodiment of the present invention.
Figure 1B:
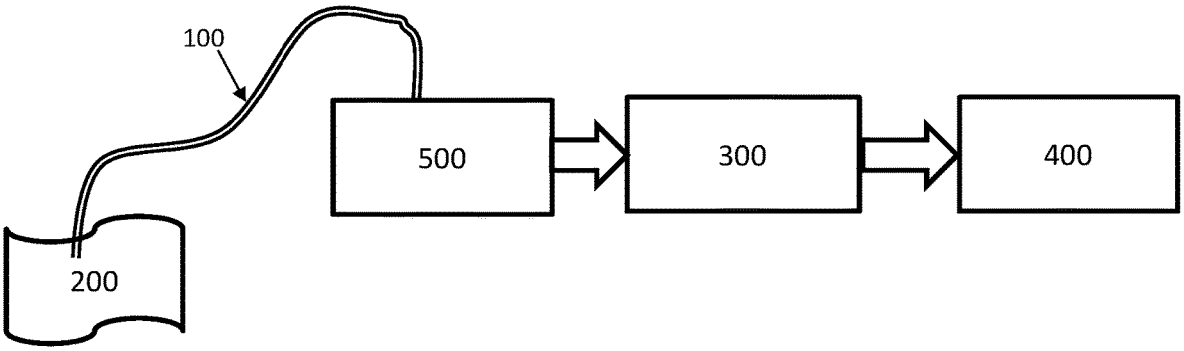
FIG. 1B shows the main elements of another embodiment of the present invention.

Main elements for surface analysis system is shown in FIGS. 1A and 1B. The system comprises of (i) a sniffing line 100 to take samples from a surface 200; (ii) a thermal desorption system 500, (iii) an ionization source 300, (iv) a mass spectrometer 400 for gas analysis, and (v) a pressure control system comprising of a set of nozzles and vacuum pumps to provide a required suction on the sniffing line and proper vacuum level in the ionization source and the mass spectrometer.

The sniffing line comprises of conductive or insulator material of different bore diameter, which may also have a heating system. The length and flexibility of the sniffing line depends on specific application. The sniffing line is pumped internally by using one of the pumps of the system. The sniffing samples in a form of gas shall be directed to an ion source for ionization. In addition, the system may have a thermal desorption device for liquid and solid samples.

The gas analyzer can be a single stage or tandem mass spectrometer such as TOF, Quadrupole, ion trap, magnetic sector, or other types of spectrometer. Exemplary mass spectrometers ("MS") include, but are not limited to, sector MS, time-of-flight MS, quadrupole mass filter MS, three-dimensional quadrupole ion trap MS, linear quadrupole ion trap MS, Fourier transform ion cyclotron resonance MS, orbitrap MS and toroidal ion trap MS.

The ionization source can comprise of an e-impact, electro-spray, corona discharge, discharge tube, Photo ionization, or other types of ionization sources.

The present system can sample any vapour, liquid or solid from a surface. Materials other than vapour will be transferred to a thermal desorption system and converted into vapor, and then to the ionization source. The gas outlet of the sniffer is coupled to the gas inlet of the thermal desorption system, the outlet of which goes to an ionization source and indirectly coupled to the gas inlet of a mass spectrometer. A gas outlet of the ionization source can be directly coupled to the gas inlet of the mass spectrometer.

Figure 2:
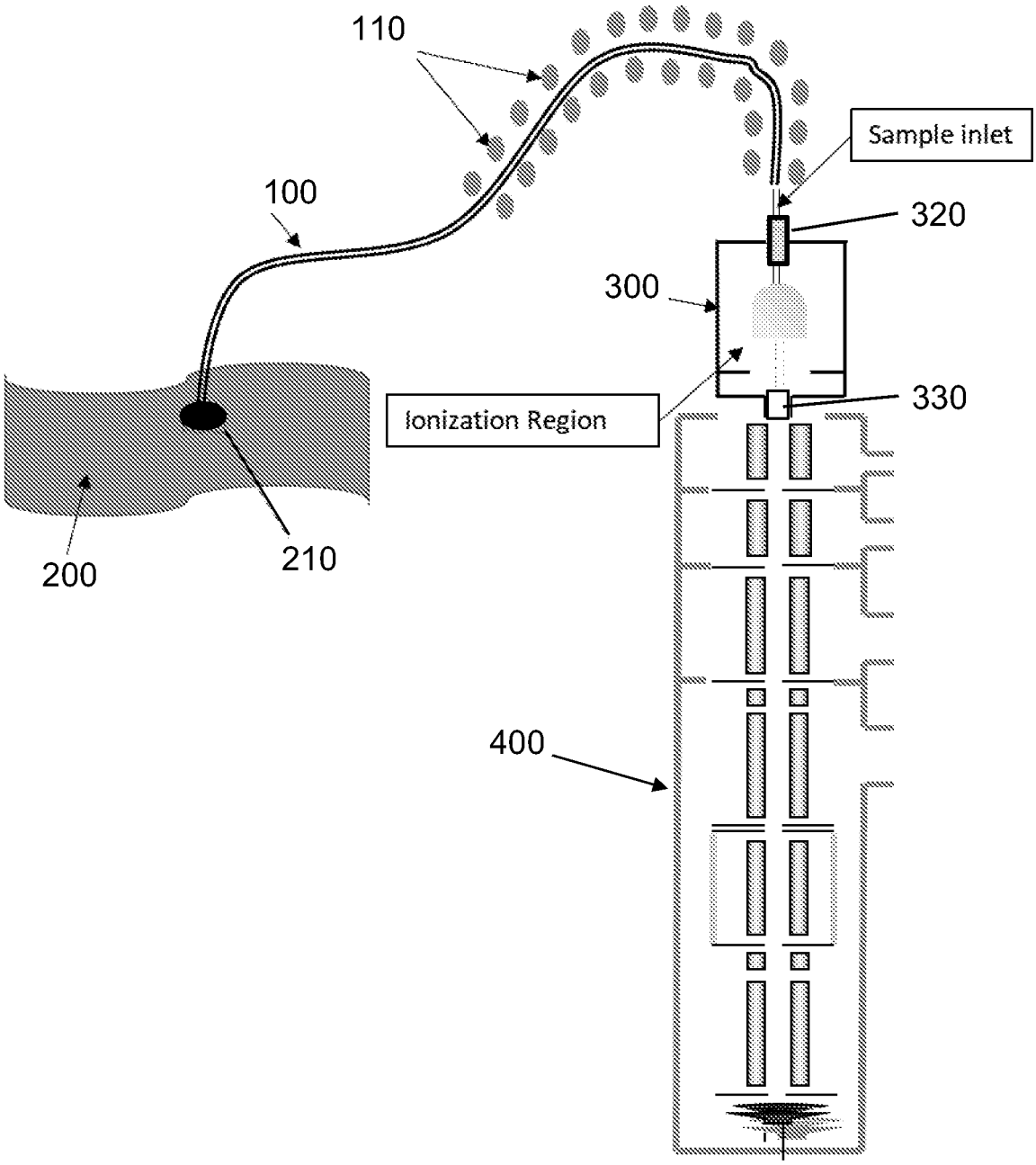
FIG. 2 shows the first embodiment of the present invention.

FIG. 2 shows a first embodiment of the present system to sample vapor and gases from a surface. In this system a sniffing line 100 is placed on a surface 200 to obtain a sample 210 from the surface to be analysed. The vapor from the surface is sucked by the sniffing line 100 into a discharged ion source 300. These gases are ionized and the ionized gases are then injected into a mass spectrometer 400. This system can be used to analyse any smell from the surface.

The sniffer 100 may have a heater 110 to heat the material that passes through it. The sniffer is made of a material that can withstand high temperatures. It can be metallic, or made of Teflon or ceramic. The sniffer 100 can be flexible or rigid. The sniffer may be handheld and be manually taken over the surface to take a sample. The sniffer may also be a robotic sniffer to operate automatically or by a remote operator.

A suction is generated by a vacuum level in the system. The system vacuum pump generates a desired vacuum in the MS, which induces a vacuum on the sniffing line. The challenge is to have a proper suction on the surface, at the same time, the desired vacuum in the MS. For this purpose, the present system has a first pressure control nozzle 320 between the sniffing line and the ionization source, and a second pressure control nozzle 330, between the ionization source and MS. These two pressure control nozzles control the pressure for the sniffing line, the pressure in the ionization source and the pressure in MS.

Figure 3A:
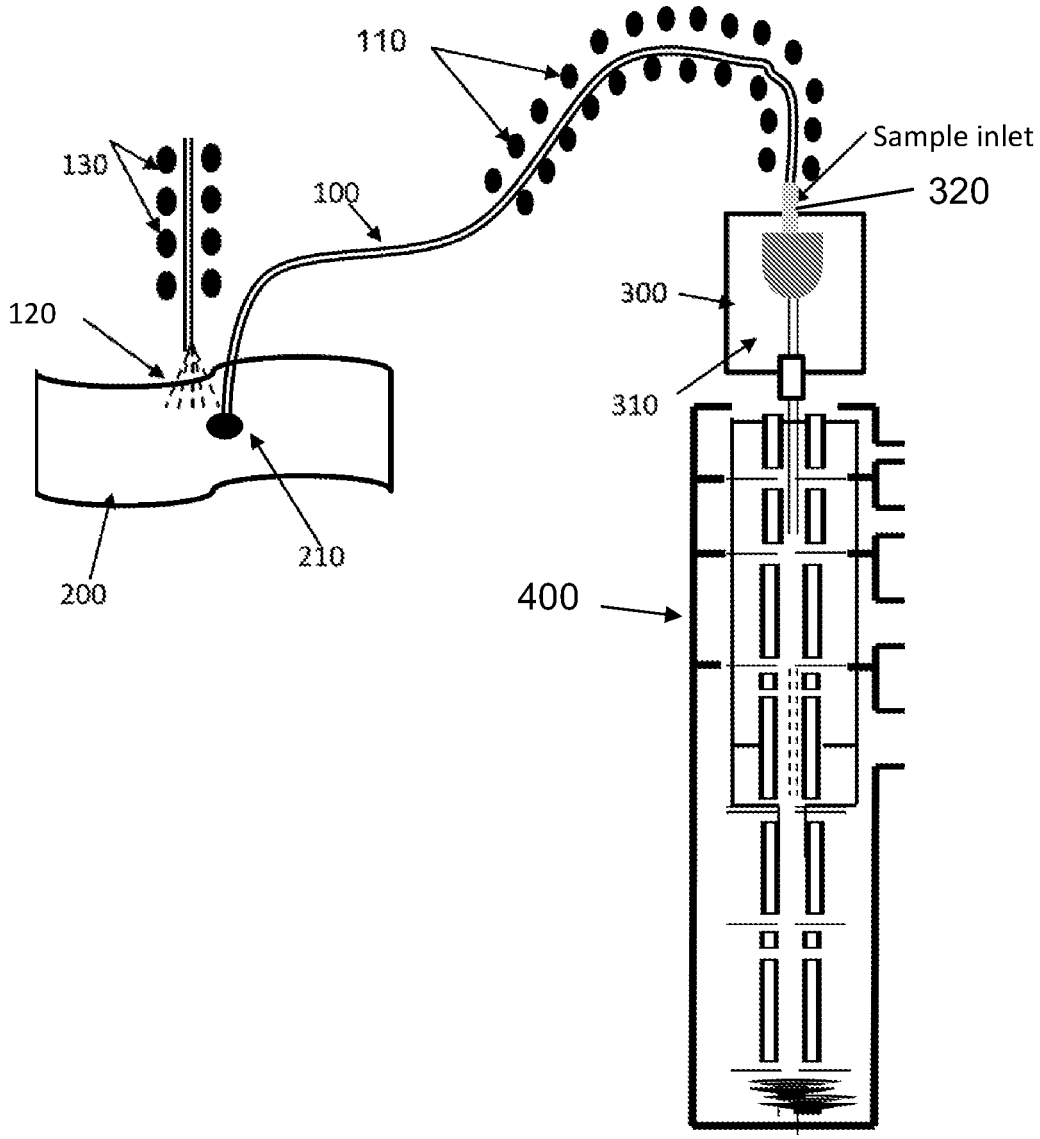
FIG. 3A shows the second embodiment of the present invention having a heated air jet to remove surface material.

FIG. 3A shows a second embodiment of the present system that has one or more air jets 120 stream to dislodge the material from the surface to be sampled by the sniffer. The air jets may have heating elements 130 to heat the air jets. The air jets 120 impinging on the surface cause that the material 210 on the surface to be removed from the surface and into the sniffer. For example, explosive material may have chemicals, such as Bromium or Chromium, which have a vapor. The sniffer can suck the vapor for analysis. The nozzle of the air/gas jets are so designed to only disturb the surface so much that the sniffer can take the gases or materials into the line. The gas flow is small, and the gas jet diameter can be as small as 100 micron.

The air jet may be a simple orifice nozzle, or may have a special design to guide the gases into the sniffer. For example, the air jet ports may be circumferentially located around the suction port of the sniffer (not shown). A variety of configurations of the air jet with respect to the suction port of the sniffer can be designed to provide optimum gas sampling.

The suction port of the sniffer can collect the dislodged material however, the suction efficiency goes down as the suction port is moved away from the surface. Well-designed air jets can improve the suction efficiently by pushing the vapour to larger distances away from the surface.

Figure 3B:
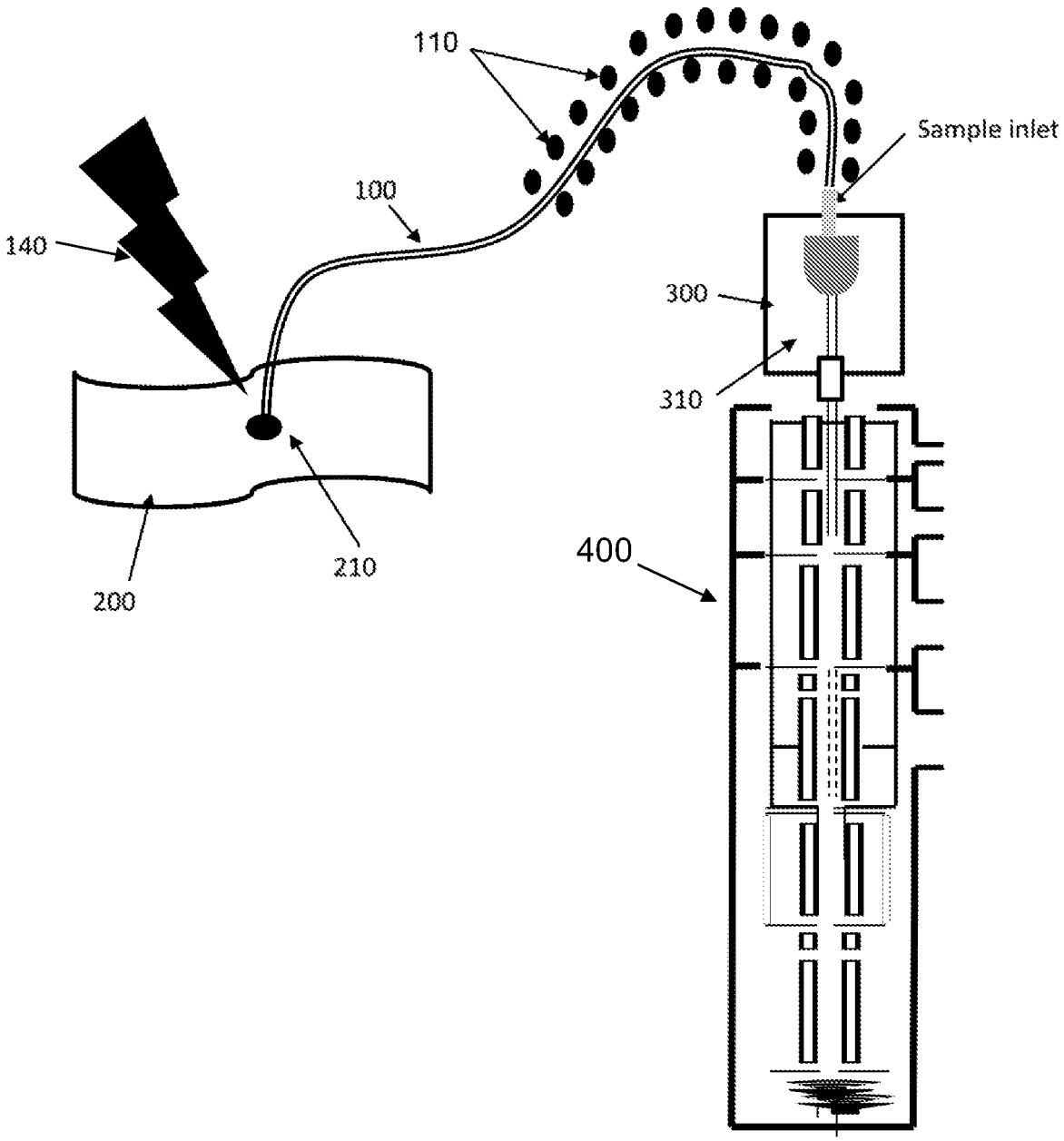
FIG. 3B shows another embodiment of the present invention having a light source to remove surface material.

FIG. 3B shows a third embodiment of the present invention that uses a heating source 140 to dislodge vapour from a surface. The heating sources can be a laser light or a UV light or other sources of heating. The light can come from the top or the bottom of the surface. Especially, if the surface is a thin surface, such as a paper, the laser or the light can come from the bottom. In another embodiment, the laser light can be strong enough to burn the surface and its material, while the sniffer takes the gases in.

Figure 4:
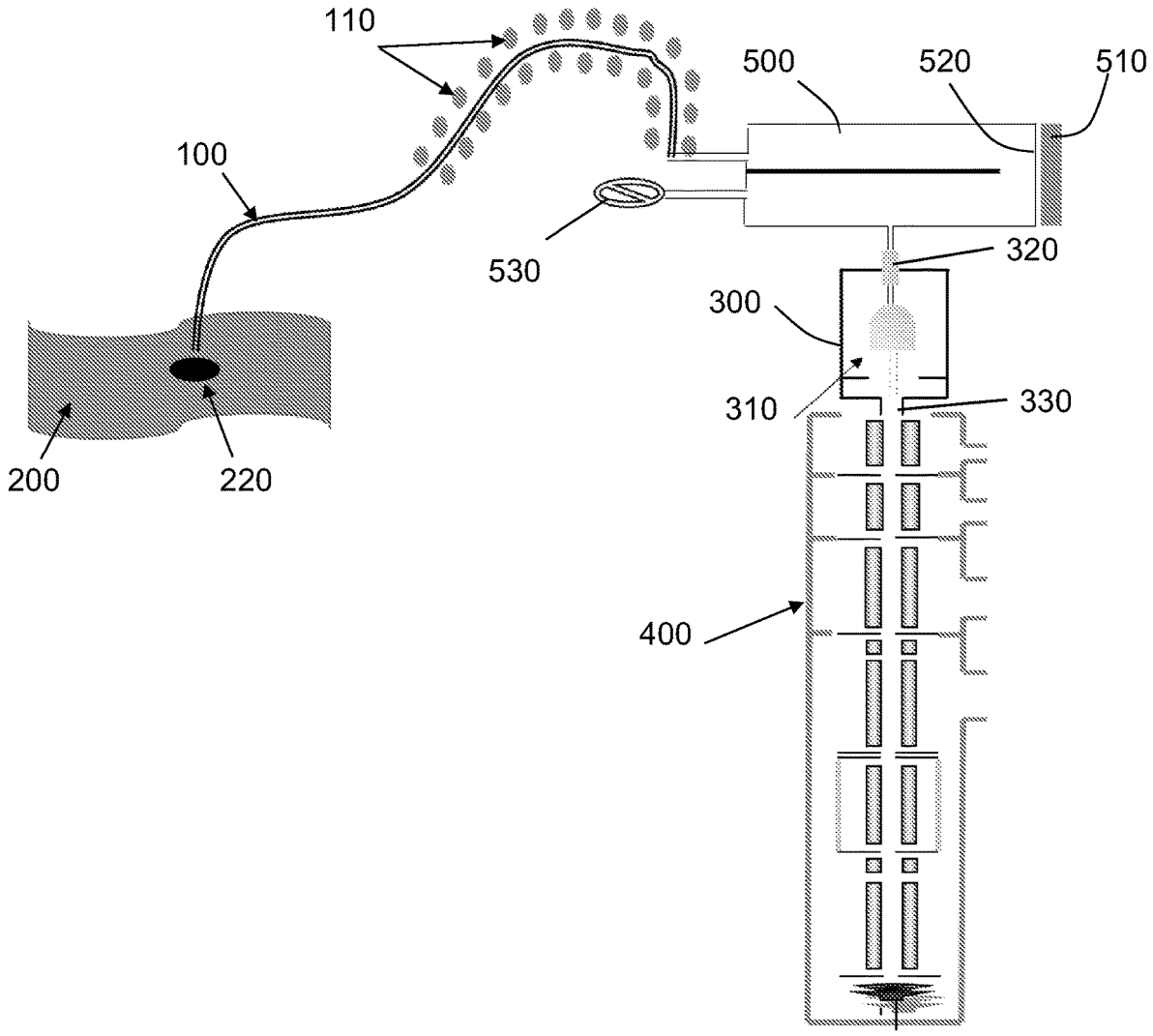
FIG. 4 shows another embodiment of the present invention having a thermal desorption system to remove vapor from a sampled material.

FIG. 4 shows the fourth embodiment of the present system that includes a thermal desorption system 500 to convert liquid and solid material into vapor. The thermal desorption system has a resistive heating system 510 or any other heating system. This provides a hot surface 520 that is used on material on the surface that do not have any smell or any vapor. This system can analyse chemical and/or biological molecules that are vapor, droplets, an aerosol, liquid, solid, or any other mobile medium in which specific molecules of interest may be transported in air. The thermal desorption system 500 may have a vacuum pump of its own 530 to keep it at a desired pressure with respect to the atmospheric pressure.

Figure 5:
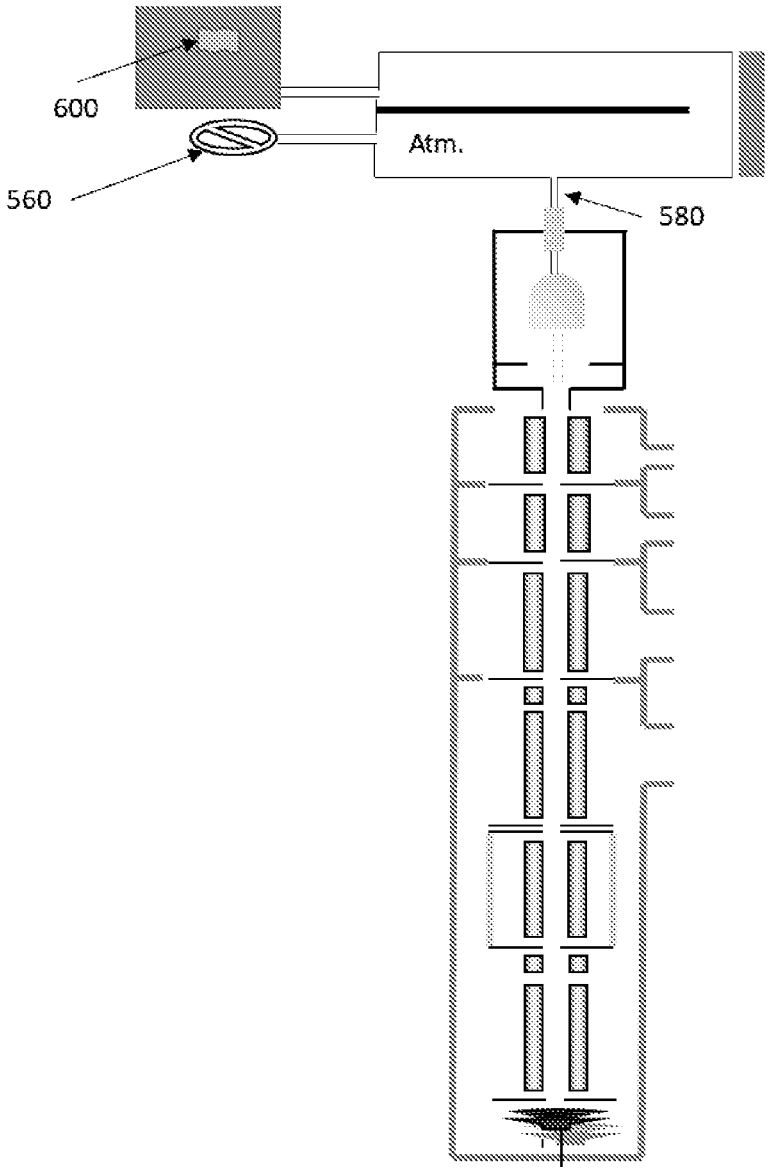
FIG. 5 shows another embodiment of the present invention using swap to collect sample.

FIG. 5 shows a fifth embodiment of the present system that uses a swap 600 to sample surface material. The swap or the wipe is then heated to remove the vapor containing material. The sample vapor, which is generated by heating the swap is then injected into the thermal desorption system 500 to release or desorb the material into a low flow rate stream of inert gas. The thermal desorption of a sample from the swab provides a part of the sample to the analyzer. The thermally desorbed parts of the sample may be analyzed to detect the presence of substances of interest in the collected sample. The swap may be used manually or it may be located at the end of wand, which is used to wipe the surface.

Figure 6A:
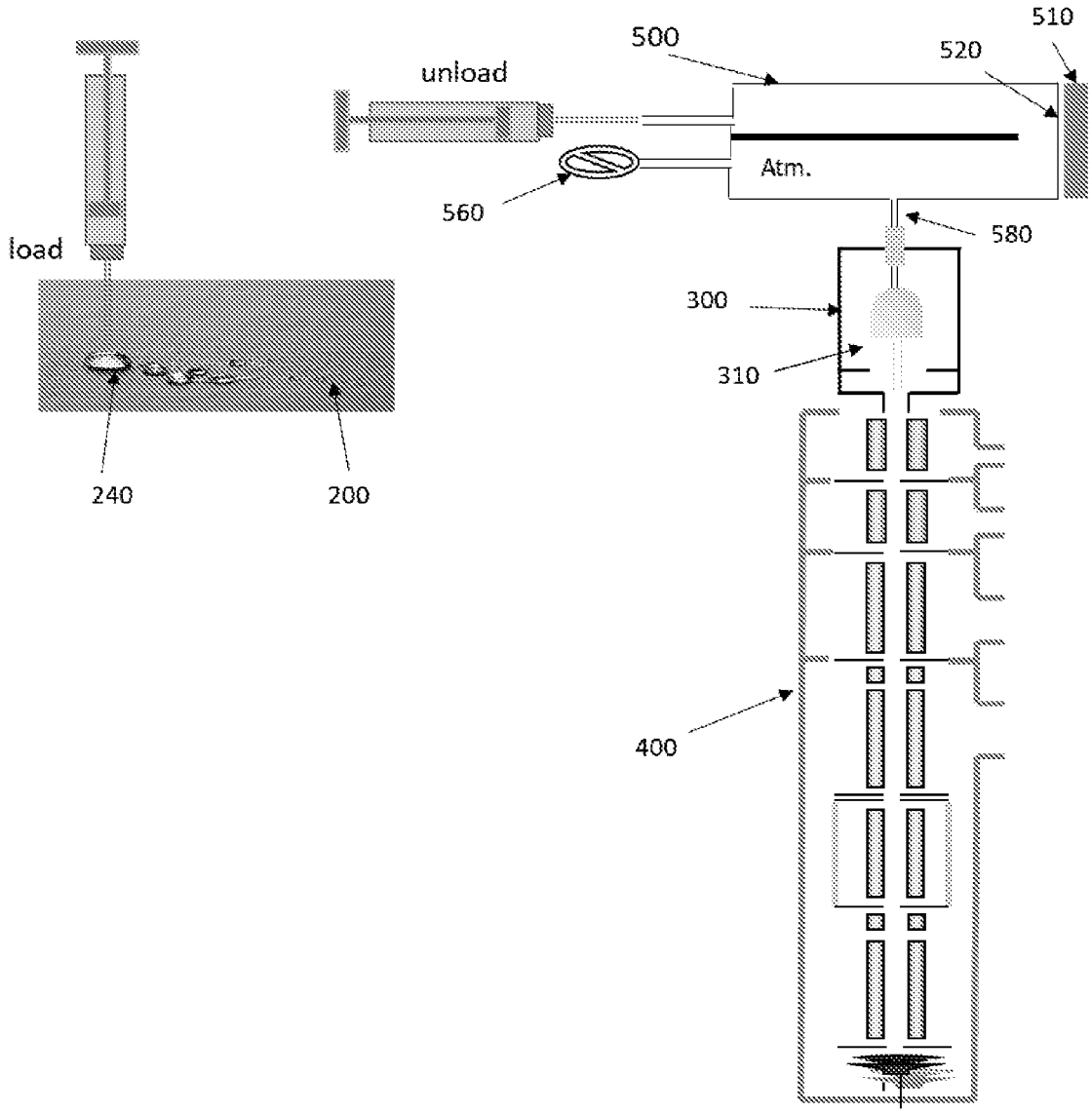
FIG. 6A shows a sixth embodiment of the present invention using a syringe to collect liquid samples.
Figure 6B:
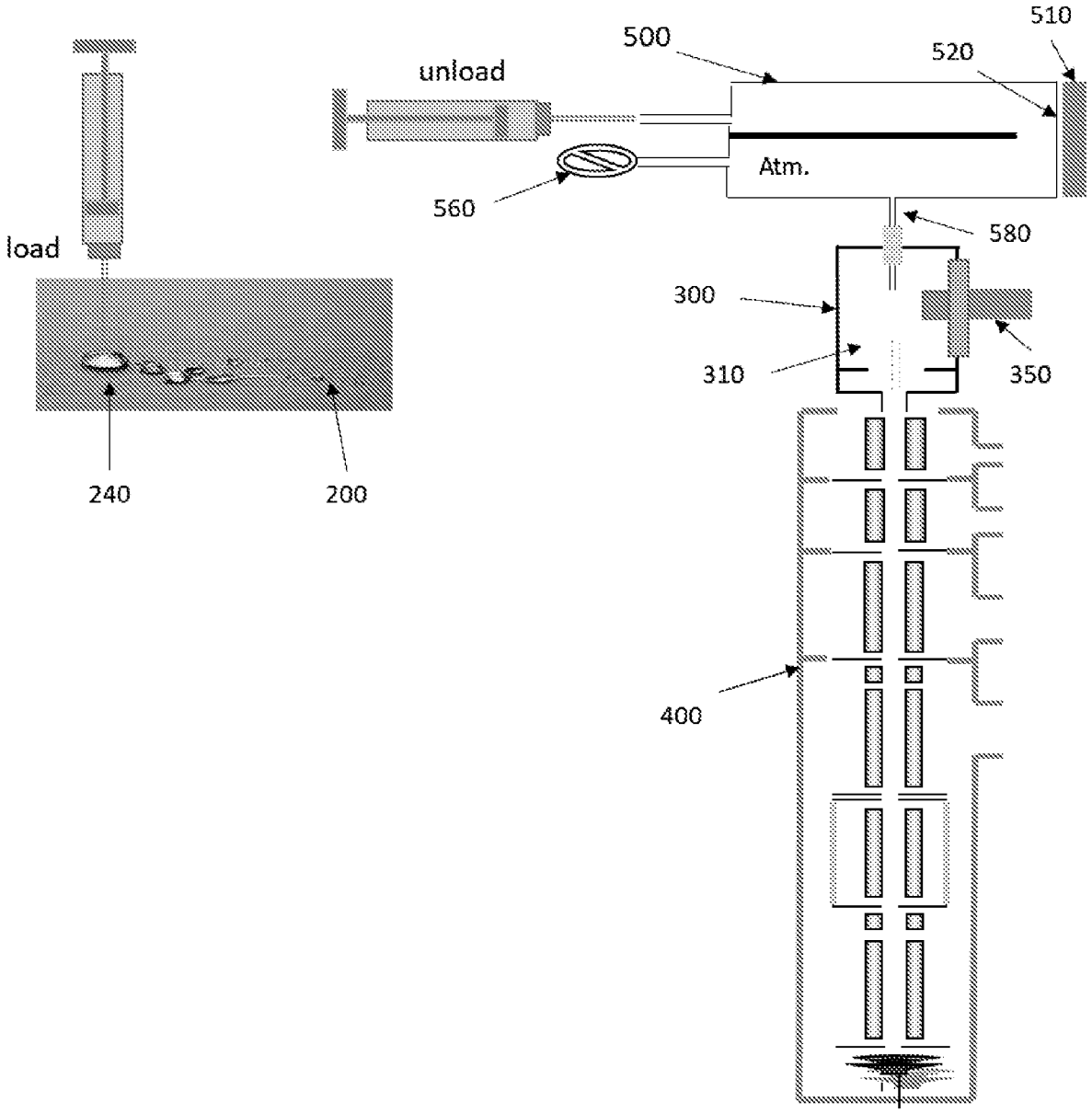
FIG. 6B shows a sixth embodiment of the present invention using a photolamp for ionization.
Figure 6C:
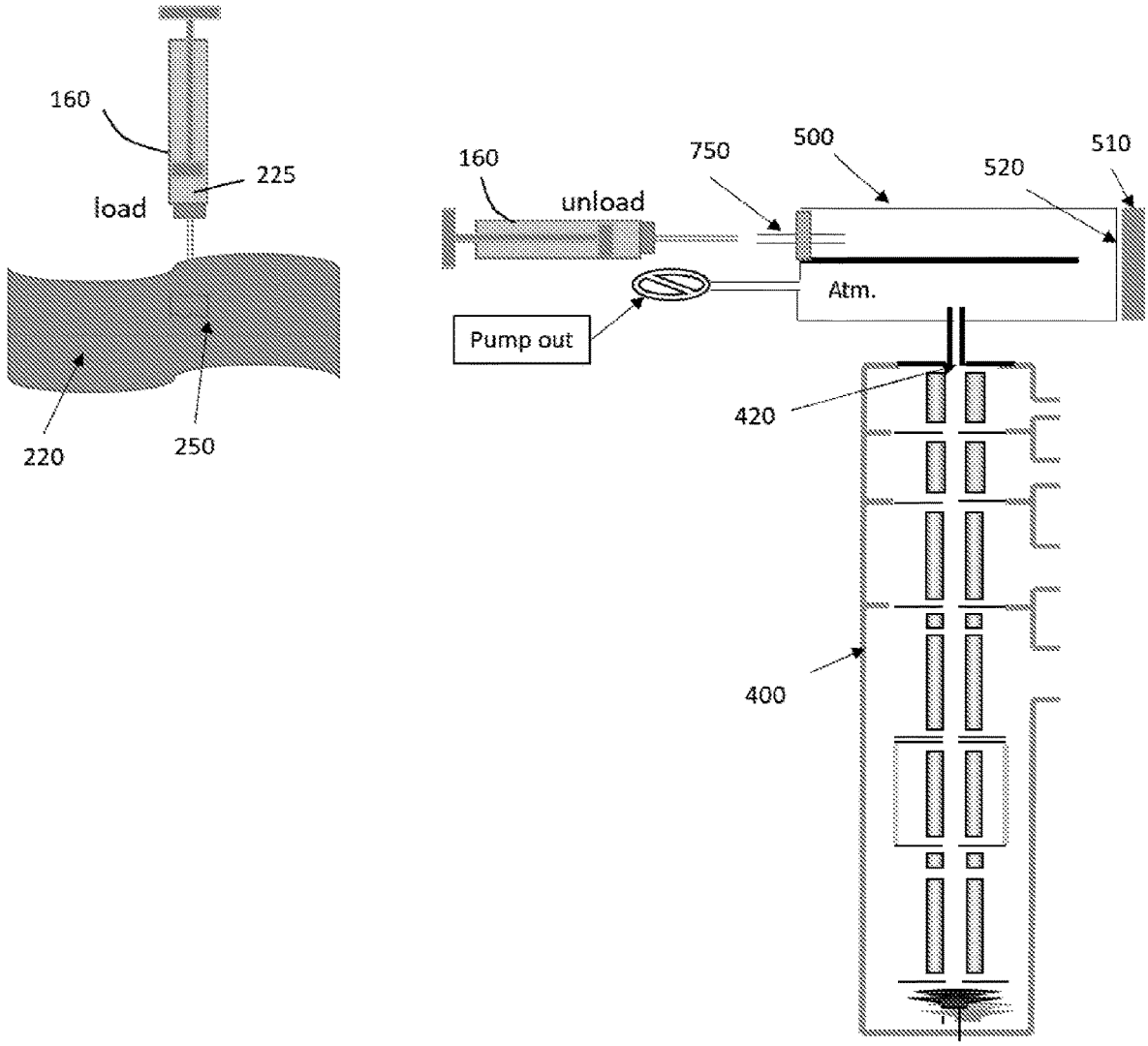
FIG. 6C shows a sixth embodiment of the present invention having an ESI system to introduce the liquid sample into the thermal desorption system.

FIGS. 6A, 6B and 6C show a sixth embodiment of the present system that is used to sample liquids and solids from a surface. In FIGS. 6A and 6B, a liquid sample 240 is sucked into a syringe 160 that is on the surface 220. In FIG. 6C, a solvent is applied on the surface to dissolve a solid sample. The liquid 255 in the syringe 160, which includes the solvent, and the material on the surface that is dissolved, is then injected in the thermal desorption system. The material is evaporated and the vapor is injected into the ionization source and then to the MS system. The thermal desorption system 500 further comprises of a heater 510 to vaporize the liquid. FIG. 6B shows another embodiment of the present invention in which a multi-photon ionic source is used as the ionization source.

Figure 7A:
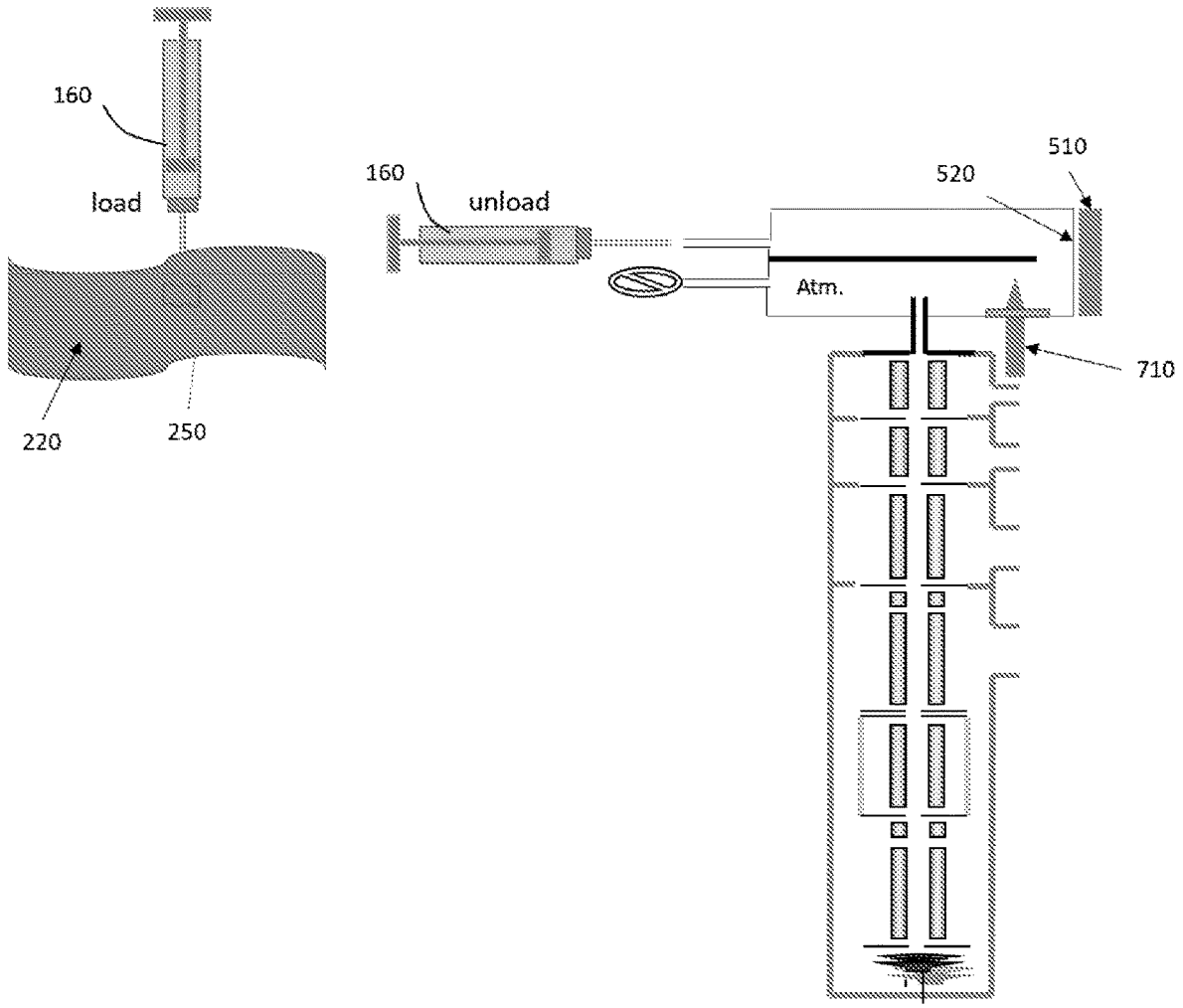
FIG. 7A shows a seventh embodiment of the present invention having a HPCI system.
Figure 7B:
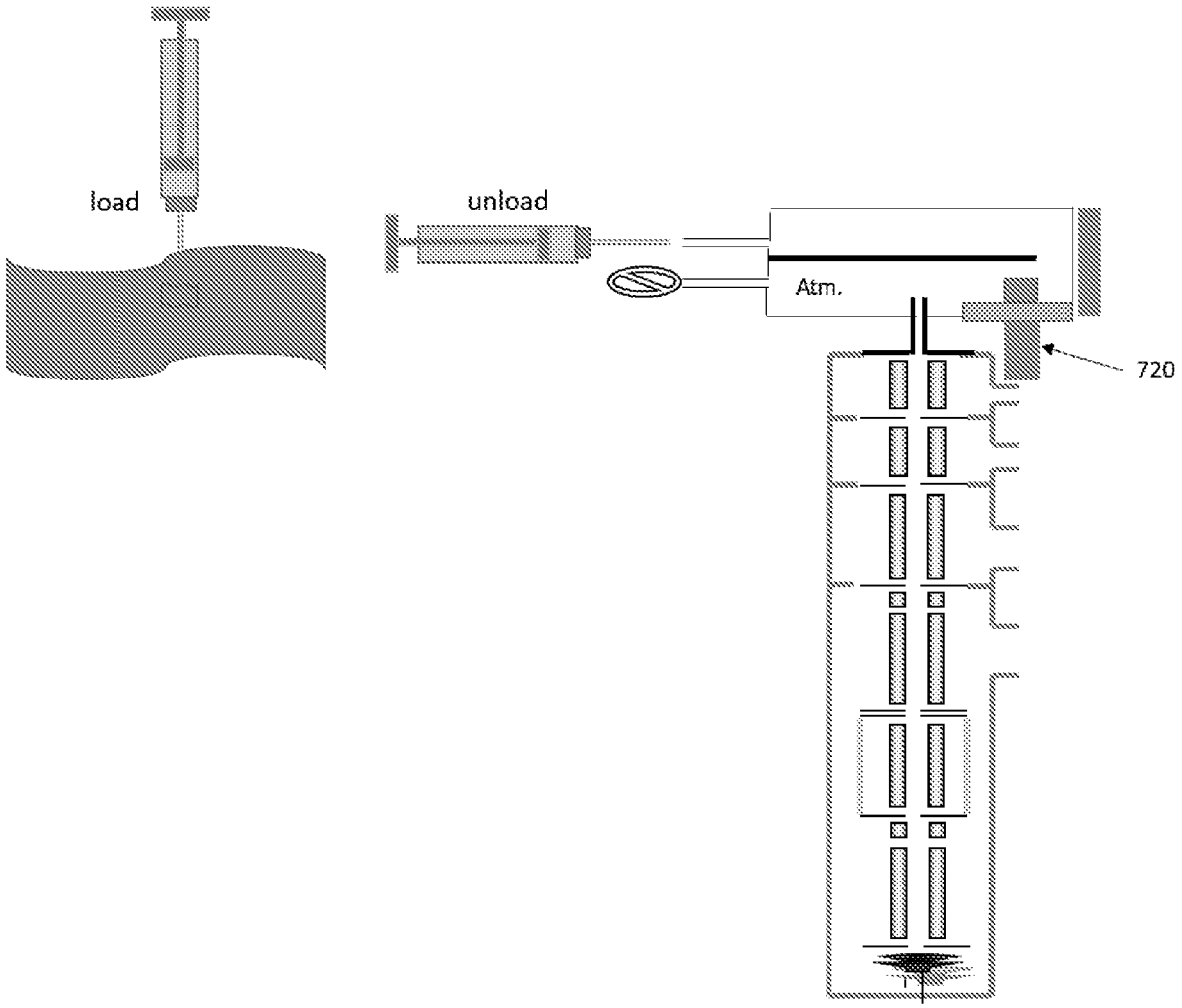
FIG. 7B shows a seventh embodiment of the present invention having a APPI system.

The ionization source in the present embodiment may be an electrospray ionization, atmospheric pressure chemical ionization, atmospheric pressure photo-ionization or inductively coupled plasma. FIGS. 7A and 7B show the seventh embodiment of the present system in which a APCI 700 or a APPI 720 is used. An electrospray ionization source (ESI) 750 may also be used to inject a polar aerosol into the thermal desorption system. A regular aerosol can also be used together with an ionization source before injecting the material into the MS.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A surface analyzing system comprising, a) a sniffing line having a sampling intake port and a sniffling vacuum pressure to collect a sample from a targeted surface;

b) an ionization source configured to receive the sample collected from the targeted surface and to generate ions;

c) a first nozzle between an ionization source intake and the sniffing line to provide a pressure drop and to control an ionization source pressure;

d) a mass spectrometer configured to receive the ions and other gases from the ionization source to analyze the sample;

e) a second nozzle between the ionization source and the mass spectrometer to control a mass spectrometer pressure, and f) a vacuum pump system configured to provide the sniffling vacuum pressure, the ionization source pressure and the mass spectrometer pressure with collaboration with the first nozzle and the second nozzle, whereby, the mass spectrometer provides real time detection and quantitation of the sample deposited on the targeted surface.

2. The surface analyzing system of claim 1, further having a thermal desorption system to heat a solid or a liquid sample and to release a vapour or a gas from the sample before introduction into the ionization source for ionization, and wherein the thermal desorption system has a second pump to control a thermal desorption pressure and the ionization source pressure.

3. The surface analyzing system of claim 1, wherein the sniffing line is operated by an internal vacuum pump of the mass spectrometer or by an external vacuum pump.

4. The surface analyzing system of claim 1, wherein the sniffing line is made of metallic material or made of Teflon or ceramic and wherein the sniffer line is flexible or rigid, and wherein the sniffer line is a handheld device and is manually taken over the surface to take a sample or it is a robotic sniffer to operate automatically or by a remote operator.

5. The surface analyzing system of claim 1, wherein the mass spectrometer is a TOF, Quadrupole, ion trap, magnetic sector, or any other types of spectrometer.

6. The surface analyzing system of claim 1, wherein the ionization source is any one of e-impact, electro-spray, corona discharge, discharge tube, Photo ionization, or other types of ionization sources.

7. The surface analyzing system of claim 1, wherein the sniffing line has a heater to heat the sample.

8. The surface analyzing system of claim 1, wherein the sniffing line has one or more air jets arranged to release and/or carry some sample from the targeted surface and configured to result in collecting any target analyte or analytes drawn into the sampling intake port of the sniffing line.

9. The surface analyzing system of claim 7, wherein the air jets are configured to impinge on a target surface at a standoff distance.

10. The surface analyzing system of claim 1, further having a syringe to inject a solvent onto the surface to dissolve the material on the surface.

11. The surface analyzing system of claim 1, wherein the surface is any one of a layer of a cell, a contaminated surface by a plurality of chemicals or biological agents, a surface of a container caring residue of explosives or narcotics materials, a ticket or a boarding card, or a surface of a product from a production line.

12. The surface analyzing system of claim 1, wherein the sniffing line comprises of an elongated wand body having a lateral surface and a distal tip and a swab support configured to support a swab, and wherein the swab support is positioned over the distal tip and coupled to the wand body lateral surface and wherein the swab support is configured to flex with respect to the wand body between a sample collection position and a heating position, while remaining attached to the wand body.

* * * * *